US011747117B1

(12) United States Patent
Ferguson

(10) Patent No.: US 11,747,117 B1
(45) Date of Patent: Sep. 5, 2023

(54) DUAL-DIAMETER ARROW SHAFT

(71) Applicant: Pro-Tracker IP Holding, LLC, Rexburg, ID (US)

(72) Inventor: Michael D. Ferguson, Rexburg, ID (US)

(73) Assignee: Pro-Tracker IP Holding, LLC, Rexburg, ID (US)

( * ) Notice: Subject to any disclaimer, the term of this patent is extended or adjusted under 35 U.S.C. 154(b) by 0 days.

(21) Appl. No.: 17/332,774

(22) Filed: May 27, 2021

Related U.S. Application Data

(60) Provisional application No. 63/030,495, filed on May 27, 2020.

(51) Int. Cl.
*F42B 6/04* (2006.01)

(52) U.S. Cl.
CPC ..... *F42B 6/04* (2013.01)

(58) Field of Classification Search
CPC ..... F42B 6/04; F42B 6/06; F42B 6/08; B25B 15/00
See application file for complete search history.

(56) References Cited

U.S. PATENT DOCUMENTS 1,493,165 A * 5/1924 Schade ..... B25G 1/00 81/436
4,016,912 A * 4/1977 St-Amour ..... B25B 15/007 81/436
4,448,183 A 5/1984 Quartino et al.
4,452,222 A 6/1984 Quartino et al.
4,494,521 A 1/1985 Quartino
4,542,731 A 9/1985 Quartino
4,819,608 A 4/1989 Filice et al.
4,846,142 A 7/1989 Tone
4,905,397 A 3/1990 Juelg, Jr.
4,957,094 A 9/1990 Pickering et al.
5,443,272 A 8/1995 Vincent, Sr.
5,491,325 A 2/1996 Huang et al.
(Continued)

FOREIGN PATENT DOCUMENTS

CA 747692 12/1966
FR 487413 7/1918
(Continued)

OTHER PUBLICATIONS

Bowhunter Magazine, Zwickey Scorpio, Nov. 1984. p. 113.
(Continued)

*Primary Examiner* — John A Ricci
(74) *Attorney, Agent, or Firm* — Clayton Howarth, P.C.

(57) ABSTRACT

A dual-diameter arrow shaft is disclosed. An arrow shaft is disclosed with a proximal diameter and a distal diameter, wherein the proximal diameter is smaller than the distal diameter, wherein the distal diameter is approximately equal to the diameter of a standard shaft hunting arrow, while the proximal diameter is approximately equal to that of a micro-diameter shaft hunting arrow. The arrow may have more weight front of center, and the distal diameter of the arrow may be suited for installing standard-sized inserts and additions to the arrow, while the proximal diameter is smaller than the distal diameter for better flight. The distal diameter is large enough for a sleeve with extra weight to fit snugly over the arrow shaft.

29 Claims, 2 Drawing Sheets

(56) References Cited

U.S. PATENT DOCUMENTS

| | | | | |
|---|---|---|---|---|
| D394,085 | S | 5/1998 | Leedy | |
| 6,017,284 | A | 1/2000 | Giles | |
| 6,179,736 | B1 | 1/2001 | Thurber | |
| 6,251,036 | B1 | 6/2001 | Wu et al. | |
| 6,520,876 | B1 | 2/2003 | Eastman, II | |
| 6,554,726 | B2 | 4/2003 | Thurber | |
| 6,821,219 | B2 | 11/2004 | Thurber | |
| 6,866,599 | B2 | 3/2005 | Eastman, II | |
| 7,201,818 | B2 | 4/2007 | Eastman, II | |
| 7,608,002 | B2 | 10/2009 | Eastman, II et al. | |
| 8,075,430 | B1 | 12/2011 | Hester | |
| 8,105,189 | B1 | 1/2012 | Huang | |
| 8,337,341 | B1 | 12/2012 | Huang | |
| 8,337,342 | B1 | 12/2012 | Huang | |
| 8,353,455 | B1 | 1/2013 | Huang | |
| 8,388,473 | B2 * | 3/2013 | Smith | F42B 6/04 473/578 |
| 8,403,777 | B1 | 3/2013 | Huang | |
| 8,608,531 | B1 | 12/2013 | Huang | |
| 8,668,605 | B1 | 3/2014 | Huang | |
| D717,389 | S | 11/2014 | Huang | |
| 8,875,687 | B1 | 11/2014 | Huang et al. | |
| 8,951,152 | B1 | 2/2015 | Huang | |
| 8,967,133 | B1 | 3/2015 | Huang | |
| 9,046,452 | B1 | 6/2015 | Huang | |
| 9,097,486 | B1 | 8/2015 | Huang | |
| 9,115,953 | B1 | 8/2015 | Huang | |
| 9,212,875 | B1 | 12/2015 | Huang | |
| 9,303,962 | B1 | 4/2016 | Burnworth et al. | |
| 9,395,166 | B1 | 7/2016 | Huang | |
| 9,441,927 | B1 | 9/2016 | Huang | |
| 9,557,148 | B2 | 1/2017 | Ledbetter | |
| 9,631,908 | B2 * | 4/2017 | Park | F42B 6/04 |
| 9,752,842 | B1 | 9/2017 | Huang | |
| 9,752,844 | B1 | 9/2017 | Huang | |
| 9,759,510 | B1 | 9/2017 | Kempf et al. | |
| 9,797,723 | B1 | 10/2017 | Huang | |
| 9,803,963 | B1 | 10/2017 | Huang | |
| 9,816,815 | B1 | 11/2017 | Huang | |
| 9,909,833 | B1 | 3/2018 | Huang | |
| 9,915,510 | B1 | 3/2018 | Huang | |
| 9,982,975 | B1 | 5/2018 | Huang | |
| 10,099,889 | B1 | 10/2018 | Huang | |
| 10,145,643 | B1 | 12/2018 | Huang | |
| 10,215,521 | B1 | 2/2019 | Huang | |
| 10,232,581 | B1 | 3/2019 | Huang | |
| 10,240,886 | B1 | 3/2019 | Huang | |
| 10,359,254 | B1 | 7/2019 | Kempf et al. | |
| 10,371,480 | B1 | 8/2019 | Huang | |
| 10,386,152 | B1 | 8/2019 | Huang | |
| 10,415,924 | B1 | 9/2019 | Huang | |
| 10,421,637 | B1 | 9/2019 | Huang | |
| 10,458,743 | B1 | 10/2019 | Kempf et al. | |
| 10,837,738 | B1 | 11/2020 | Huang | |
| 10,859,354 | B1 | 12/2020 | Huang | |
| 10,948,257 | B1 | 3/2021 | Huang et al. | |
| 11,022,413 | B1 * | 6/2021 | Broderick | F42B 6/08 |
| 11,098,994 | B1 | 8/2021 | Huang | |
| 11,525,646 | B1 | 12/2022 | Huang | |
| 2008/0176681 | A1 | 7/2008 | Donahoe | |
| 2009/0062042 | A1 | 3/2009 | Huang et al. | |
| 2009/0291785 | A1 | 11/2009 | Smith | |
| 2017/0052007 | A1 | 2/2017 | Syverson et al. | |
| 2017/0314898 | A1 | 11/2017 | Syverson et al. | |

FOREIGN PATENT DOCUMENTS

| | | |
|---|---|---|
| FR | 1022401 | 3/1953 |
| FR | 2689228 | 10/1993 |
| GB | 114274 | 3/1918 |
| GB | 635439 | 3/1949 |
| GB | 1430790 | 4/1976 |
| GB | 1590954 | 6/1981 |
| SU | 1675649 | 9/1991 |
| WO | WO2012115673 | 8/2012 |
| WO | WO2019209388 | 10/2019 |

OTHER PUBLICATIONS

1986 Saunders Successories Catalog. Arrow Penetration Limiter. Jul. 1986. p. 9.

Arrow Dynamics Cutting Edge Arrow Design Home Products and Contact webpage https://www.tradgang.com/ad/products.html Jan. 5, 2021.

Double Splined Arrows Crossbow Nation Forum https://www.crossbownationa.com/community/threatds/double-splined-ar. . . . Posted Aug. 16, 2017.

Top 10 Best Carbon Arrows for Hunting in 2020: Reviews and Guide https://safariors.com/best-carbon-arrows-hunting/ Last Updated on Apr. 26, 2020.

ArrowTrade Magazine, May 1997, advertisement for Gold Tip.

ArrowTrade Magazine, Jan. 1998, advertisement for Carbon Tech, Inc., p. 32.

Lamiglas Incorporated, Jan. 18, 1978, Dealer Price for Graphite Hunting Arrow Shaft and Graphite Stabilizers.

Lamiglas shaft specs, Aug. 14, 1978.

Letter from Lamiglas to Mr. Joe Schnell, dated Aug. 28, 1986 regarding Arrow Shaft Manufacturing Equipment List.

Letter from RESCO, Inc. to Martin Archery, dated Jun. 27, 1994.

Letter from RESCO, Inc. to Ed Schlice, dated Apr. 7, 1998.

Cabela's SST Graphite, "The Ultimate Hunting Arrow".

Graphite, The ultimate arrow sent from Lamiglas Mar. 12, 2001.

Arrow Dynamics Brochure, "Looks Like a Dart, Shoots Like a Dart Arrows", 2000-2001.

* cited by examiner

DUAL-DIAMETER ARROW SHAFT

CROSS-REFERENCE TO RELATED APPLICATIONS

This application claims the benefit of U.S. Provisional Application No. 63/030,495, filed May 27, 2020, for a Dual-Diameter Arrow Shaft which is hereby incorporated by reference herein in its entirety by this reference, including but not limited to those portions that specifically appear hereinafter, this incorporation by reference being made with the following exception: In the event that any portion of the above-referenced application is inconsistent with this application, this application supercedes the above-referenced application.

STATEMENT REGARDING FEDERALLY SPONSORED RESEARCH AND DEVELOPMENT

Not Applicable.

BACKGROUND

This disclosure relates generally to archery, and more particularly, to hunting arrows and dual diameter arrow shafts.

The bow hunting of big game animals is a popular sport, particularly in the United States. White-tailed deer, mule deer, elk, antelope and bear are only a few of the species currently being hunted. State-of-the-art hunting arrows are typically made of fiberglass, aluminum, carbon reinforced plastic or composite materials and are provided with a removable and interchangeable tip, or "broadhead." The type, size, weight, etc., of a broadhead may be changed depending upon the animal being hunted, the weather conditions, the terrain, etc. In addition, weights may be added to the front of the arrow in order to increase the amount of weight that is Front of Center (FOC), which generally increases the penetrating power of a hunting arrow. The arrow itself varies in length depending upon the person shooting and the draw length of the bow. It ranges from 14 inches to 31 inches, or longer. The length of the arrow varies mainly according to the draw length of the bow (which depends on the calibration of the bow and the person shooting it (for a compound bow) or the length of the bow (which varies according to the person shooting it) (for a longbow or recurve bow). It also depends on the type of tip being used (often a broadhead in hunting), the experience of the person shooting, and the bow itself. Arrow shafts are generally manufactured long and are cut to the proper size for a particular bow upon being purchased. The arrow also can vary in diameter: Many archery target shooting organizations allow arrows up to 10.7 mm in diameter, while some allow only arrows up to 9.3 mm in diameter. Most hunting arrows, however, have significantly smaller diameters, to allow for less wind resistance and to decrease the effect a cross wind might have on a shot. It is generally accepted that smaller-diameter arrow have better penetration such that many hunters prefer smaller diameter arrows. Very small diameter shafts are known as micro-diameter shafts. Micro-diameter shafts can achieve better penetration and are less affected by the wind and air resistance.

Sometimes an archer may desire to add weights or other additions (such as a tracking device) to an arrow. Weights can often be added to the front of an arrow to aid in the penetration. However, some weights, as well as other inserts that can be installed on an arrow, are often designed to fit a standard-sized arrow, and many will not fit on a micro-diameter arrow. In addition, installing a broadhead on a micro-diameter arrow may require the addition of an outsert, which can cause the breakage of an arrow if the angle of penetration for the arrow is far from the perpendicular. As such, an archer must choose whether to use a smaller-diameter arrow or use the additions. As such, there is a need for an arrow shaft with a diameter that fits the sleeve in the area where the sleeve is attached to the arrow, but which has a smaller diameter throughout the main shaft of the arrow to allow an archer to keep at least some of the benefits of a micro-diameter arrow. The features and advantages of the disclosure will be set forth in the description which follows, and in part will be apparent from the description, or may be learned by the practice of the disclosure without undue experimentation. The features and advantages of the disclosure may be realized and obtained by means of the instruments and combinations particularly pointed out herein.

SUMMARY OF THE DISCLOSURE

One illustrative embodiment of the present disclosure may comprise a shaft of a hunting arrow designed to have a larger diameter on the first four inches of the arrow and a second diameter throughout most of the arrow. This allows for a sleeve weight to snugly fit on the front four inches of the arrow while allowing the remainder of the arrow to have a smaller diameter for better flight and penetration.

Another illustrative embodiment shows the shaft used to construct a full hunting arrow with tip, fletching, and nock attached.

BRIEF DESCRIPTION OF THE DRAWINGS

The features and advantages of the disclosure will become apparent from a consideration of the subsequent detailed description presented in connection with the accompanying drawings in which.

DETAILED DESCRIPTION

Figure 1A:
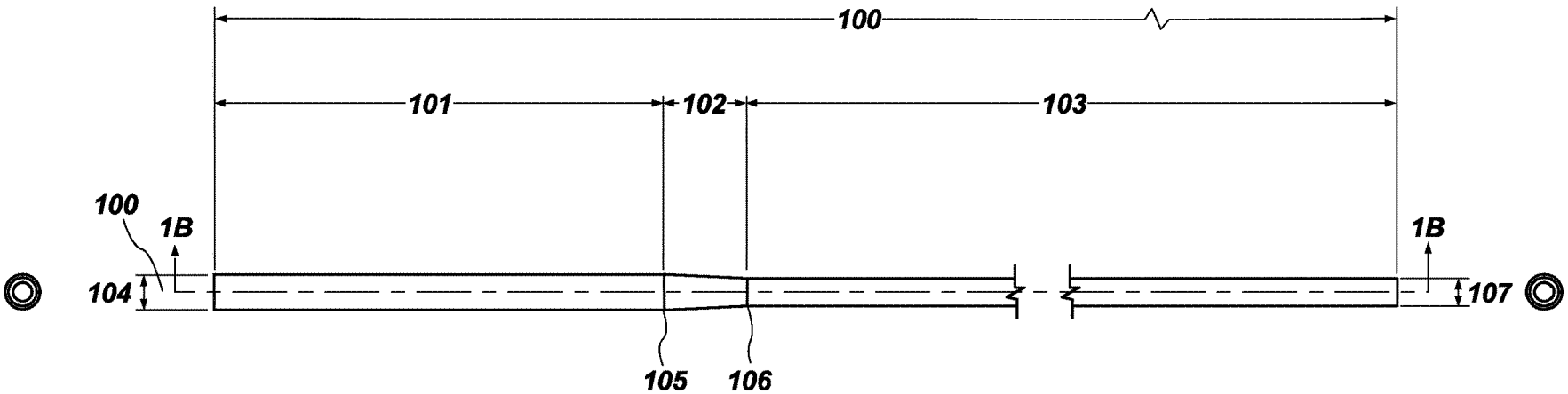
FIG. 1A is a view of one embodiment of a dual-diameter arrow shaft from the side, showing the front portion of one diameter tapering to a narrower diameter for the remainder of the arrow.

For the purposes of promoting an understanding of the principles in accordance with this disclosure, reference will now be made to the embodiments illustrated in the drawings and specific language will be used to describe the same. It will nevertheless be understood that no limitation of the scope of the disclosure is thereby intended. Any alterations and further modifications of the inventive features illustrated herein, and any additional applications of the principles of the disclosure as illustrated herein, which would normally occur to one skilled in the relevant art and having possession of this disclosure, are to be considered within the scope of the disclosure claimed.

Before the devices, systems, processes and methods will be disclosed and described, it is to be understood that this disclosure is not limited to the particular configurations, process steps, and materials disclosed herein as such configurations, process steps, and materials may vary somewhat. It is also to be understood that the terminology employed herein is used for the purpose of describing particular illustrative embodiments only and is not intended to be limiting since the scope of the disclosure will be limited only by the appended claims and equivalents thereof.

In describing and claiming the subject matter of the disclosure, the following terminology will be used in accordance with the definitions set out below.

It must be noted that, as used in this specification and the appended claims, the singular forms "a", "an", and "the" include plural referents unless the context clearly dictates otherwise.

As used herein, the terms "comprising," "including," "containing," "characterized by," "having" and grammatical equivalents thereof are inclusive or open-ended terms that do not exclude additional, unrecited elements or method steps.

As used herein, the term "proximal" shall refer broadly to the concept of a nearest portion. For example, the end of the arrow comprising fletching is the proximal-most portion of the arrow, because it is the nearest portion to the shooter as the arrow is traveling toward a target. As such, the "proximal" end of the arrow may also be referred to as the "back" of the arrow.

As used herein, the term "distal" shall generally refer to the opposite of proximal, and thus to the concept of a further portion, or a furthest portion, depending upon the context. For example, the end of an arrow comprising the tip is the distal-most portion of the arrow, because it is the farthest portion to the shooter as the arrow is traveling toward a target. Therefore the "distal" end of an arrow may also be referred to as the "front" of the arrow.

As used herein, the phrase "in an at least partially proximal-to-distal direction" shall refer generally to a two-dimensional concept of direction in which the "proximal-to-distal" direction defines one direction or dimension. An item that extends in a non-parallel direction with respect to the "proximal-to-distal" direction, that is, at a non-straight angle thereto, thereby involves two components of direction, one of which is in the "proximal-to-distal" direction and the other being in a direction orthogonal to the "proximal-to-distal" direction.

FIG. 1A illustrates one embodiment of a dual-diameter arrow. Said arrow is designed to have a portion of the arrow which has one diameter, and a second portion which has a different diameter, with a connecting section in-between where the diameter slowly tapers from the first diameter to the second diameter. The arrow may be made of carbon fiber. The arrow may be molded by layering carbon fiber into the mold and filling the mold with resin, as known in the art, or it may be spun, by winding the carbon fiber around a mandrel, or core. Other methods of manufacturing carbon fiber arrows may be used, as any method of manufacture which may be used to produce the proper shape as disclosed herein is intended to be encompassed by this disclosure. While this disclosure is primarily directed to arrows made of carbon fiber, it is to be understood that arrows with a similar shape could be created out of other materials, such as aluminum, wood, or bamboo, and that similar arrows created out of other materials are intended to be within the scope of this disclosure.

Still referring to FIG. 1A, the arrow shaft 100 may have a "distal" section 101, a "middle" section 102, and a "proximal" section 103, where "section" defines a fractional portion of the arrow. In one embodiment, the distal section 101 has a diameter 104 of approximately 0.313 inches (7.94 mm). In another embodiment, the distal section 101 may have a diameter of approximately 0.30 inches (7.64 mm). The distal section 101 may have a length of approximately 4.00 inches (101.6 mm). In one embodiment, the middle section 102 may have a distal diameter 105 of 0.313 inches on the distal end of the middle section 102 and a proximal diameter 106 of 0.244 inches (6.2 mm) on the proximal end of the middle section 102. In one embodiment, the diameter of the arrow tapers evenly across the middle section 102 from the distal diameter 105 to the proximal diameter 106. In one embodiment, the middle section 102 may have a length of 0.75 inches (19.5 mm). In one embodiment, the distal section has a larger diameter equivalent to that of a standard diameter hunting arrow. As such, inserts, broadheads, and additional equipment, such as tracking devices or additional weights may be installed on the distal section with little to no adjustment that would be required for a micro-diameter arrow shaft.

Still referring to FIG. 1A, in one embodiment, the proximal section 103 encompasses the remainder of the arrow, from the middle section 102 to the proximal end 110 of the arrow. In one embodiment, the proximal section 103 may be approximately 27.25 inches (692.15 mm) long. In one embodiment, the proximal section 103 has a diameter 107 of approximately 0.244 inches (6.2 mm). In another embodiment, the proximal section 103 may have a diameter 107 of approximately 0.126 inches (3.2 mm). In yet another embodiment, the proximal section 103 may have a diameter of 0.165 inches (4.2 mm). In one embodiment, the smaller diameter of the proximal section of the arrow provides less resistance upon penetration of target, for example when hunting. This allows the arrow to penetrate further while hunting and gives better results. In one embodiment, the straightness of the arrow shaft may be approximately +/−0.003 inch. In another embodiment, the straightness of the shaft may be +/−0.001 inch.

In one illustrative embodiment, the sections of the arrow may be of different lengths, such that the middle section 102 may not actually include the mathematical center of the arrow. In one embodiment, the proximal section 103 may make up the majority of the length of the arrow, such that both the distal section 101 and the middle section 102 are forward of the mathematical center of the arrow. In one embodiment, this may cause the arrow to have more weight forward of the center, which may increase the stability of the arrow. In one embodiment, the proximal section may have one diameter, referred to as the "proximal" diameter, while the distal section may have a second, different diameter, referred to as the "distal" diameter. In one embodiment the "middle" section may have a diameter which evenly tapers from the "distal" diameter to the "proximal" diameter, such that there is no sudden change in diameter. In one embodiment the distal diameter may be greater than the proximal diameter.

Figure 1B:
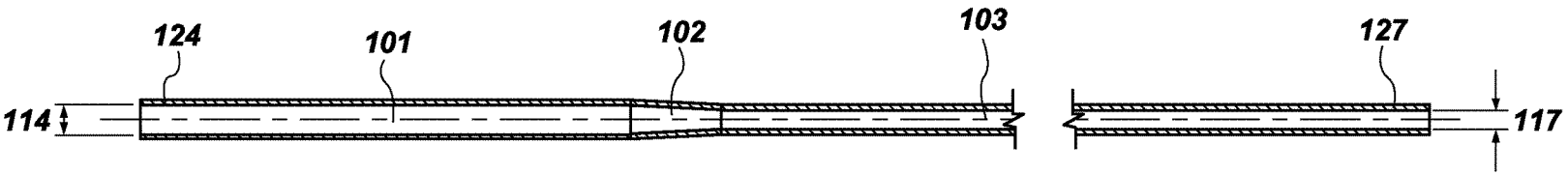
FIG. 1B is a cross-sectional view of FIG. 1A, showing the interior diameter and thickness of one embodiment of a dual-diameter arrow shaft.

In one illustrative embodiment of a dual-diameter arrow 101, shown in FIG. 1B, the distal interior diameter 114, which is the interior diameter of the distal section 101 of the arrow shaft, may be greater than the proximal interior diameter 117, which is the interior diameter of the proximal section 103 of the arrow shaft 100. In one embodiment, the distal thickness 124, which may be the thickness of the wall of the arrow shaft in the distal section 101 may be smaller than the proximal thickness 127, which may be the thickness of the wall of the arrow shaft in the proximal section 103 of the arrow.

Still referring to FIG. 1B, in one embodiment of the instant disclosure, the interior diameter of the arrow in the middle section 102 gradually decreases throughout the middle section from the distal interior diameter 114 at the distal end of the middle section 105 to the proximal interior diameter 117 at the proximal end 106 of the middle section, while the thickness gradually increases from the distal thickness 124 to the proximal thickness 127. In one embodiment, the distal interior diameter 114 is approximately 0.247 inches (6.27 mm), while the proximal interior diameter 117 is approximately 0.1654 inches (4.2 mm). The distal thickness 124 is approximately 0.066 inches (1.67 mm) and the proximal thickness 127 is approximately 0.0786 inches (2 mm). The change in thickness may help strengthen the arrow in the portions of the arrow which have a smaller diameter and require additional strength.

Figure 2A:
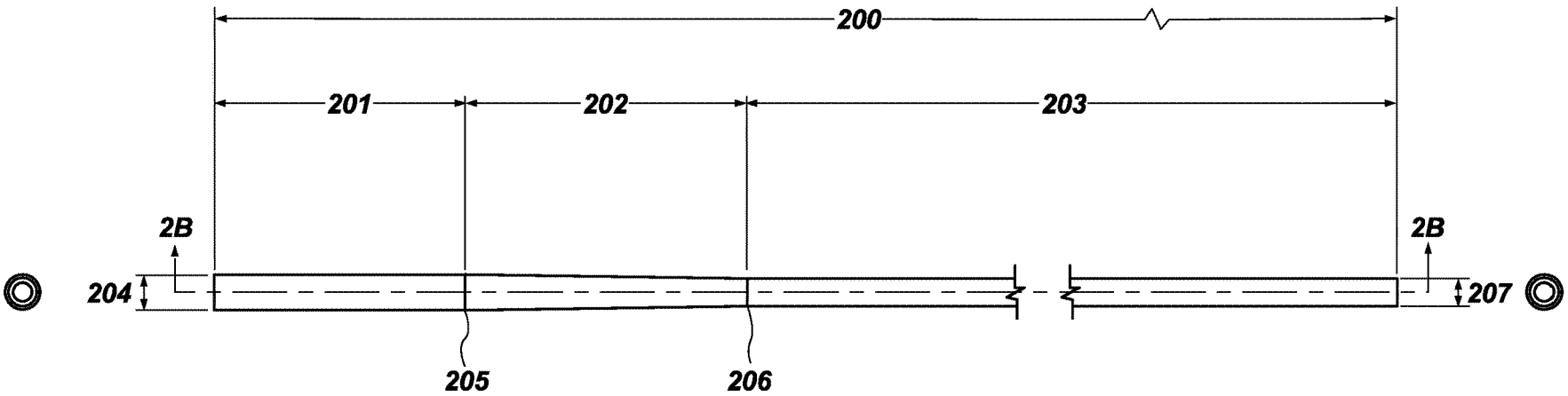
FIG. 2A is a view of a second embodiment of a dual-diameter arrow shaft from the side, showing a larger middle section where the arrow tapers from the larger distal diameter to the narrower proximal diameter

In another illustrative embodiment of a dual-diameter arrow shaft, shown in FIG. 2A, the distal section 201 of the arrow has a distal diameter 204 of between approximately 0.275 inches and 0.393 inches (7 mm-10 mm). In another embodiment, the distal diameter 204 is approximately 0.31 inches (7.9 mm). The distal section 201 may have a length of between 4 inches and approximately 6 inches (101 mm-153 mm). In another illustrative embodiment, the length of the distal section is approximately 5.2 inches (132 mm). In one embodiment the middle section 202 may have a distal diameter 205 which is equal to the distal diameter 204 of the arrow shaft itself, while having a proximal diameter 206 equal to a proximal diameter of the arrow shaft itself. In one embodiment, the diameter of the arrow tapers evenly across the middle section 202 from the distal diameter 205 to the proximal diameter 206. In one embodiment, the middle section 202 may have a length of between approximately 5 inches and approximately 7 inches (127 mm-178 mm). In another embodiment, the middle section may have a length of approximately 6.1 inches (155 mm). In one embodiment, the distal section has a larger diameter equivalent to that of a standard diameter hunting arrow. As such, inserts, broadheads, and additional equipment, such as tracking devices or additional weights may be installed on the distal section with little to no adjustment that would be required for a micro-diameter arrow shaft.

Still referring to FIG. 2A, in one exemplary embodiment of the instant invention, the proximal section 203 encompasses the remainder of the arrow, from the middle section 202 to the proximal end 210 of the arrow. In one embodiment this length is approximately 20.7 inches (526 mm). In one embodiment the total length of the arrow is approximately 32 inches, but the total length may be any length which is appropriate for a hunting arrow, depending on the bow in which is to be used. In one embodiment, the proximal section 203 has a diameter 207 of between approximately 0.12 inches and approximately 0.28 inches (3-7 mm). In one embodiment, the diameter of the proximal section is approximately 0.255 inches (6.47 mm). In one embodiment, the smaller diameter of the proximal section of the arrow provides less resistance upon penetration of target, for example when hunting. This feature may allow the arrow to penetrate further into the target when hunting and provide better results.

Figure 2B:
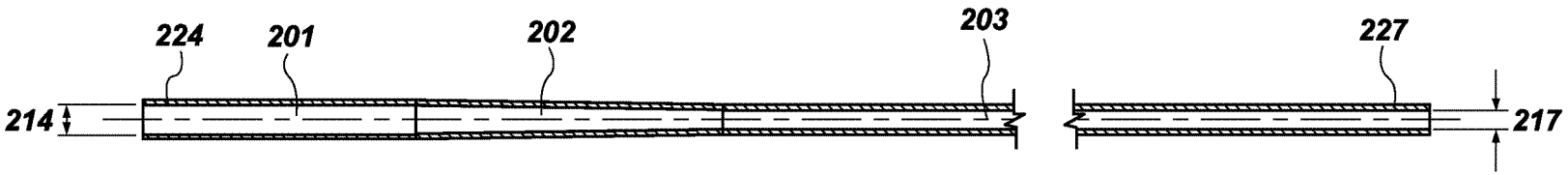
FIG. 2B is a cross-sectional view of the arrow in FIG. 2A, showing the interior diameter and thickness of a second embodiment of the dual-diameter arrow shaft.

In another illustrative embodiment of a dual diameter arrow shaft 200, represented in FIG. 2B, showing a cross-sectional view of the arrow, the distal interior diameter 214, which is the interior diameter of the distal section 201 of the arrow shaft, may be greater than the proximal interior diameter 217, which is the interior diameter of the proximal section 203 of the arrow shaft 200. In one embodiment, the distal thickness 224, which may be the thickness of the wall of the arrow shaft in the distal section 201 may be smaller than the proximal thickness 227, which may be the thickness of the wall of the arrow shaft in the proximal section 203 of the arrow. The change in thickness may help strengthen the arrow in the portions of the arrow which have a smaller diameter and provide additional strength to avoid the arrow breaking upon impact at the target.

Still referring to FIG. 2B, in one embodiment of the instant disclosure, the interior diameter of the arrow in the middle section 202 gradually decreases throughout the middle section from the distal interior diameter 214 at the distal end of the middle section 205 to the proximal interior diameter 217 at the proximal end of the middle section 206, while the thickness gradually increases from the distal thickness 224 to the proximal thickness 227. In one embodiment, the distal interior diameter 214 may be approximately 0.245 inches (6.22 mm), while the proximal interior diameter 217 is approximately 0.165 inches (4.19 mm). The distal thickness 224 may be approximately 0.033 inches (0.84 mm) and the proximal thickness 227 may be approximately 0.046 inches (1.2 mm).

In another exemplary embodiment, the diameter of the distal section of the shaft may be equal to the diameter of any standard-diameter hunting arrow. This diameter may be from between approximately 7 mm and approximately 10 mm. The diameter of the proximal section of the shaft is equal to the diameter of a micro-diameter hunting arrow shaft. In one embodiment, the middle section of the arrow shaft may have a length which varies depending on the difference between the diameter of the of the shaft in the proximal section and the diameter of the shaft in the distal section. In one embodiment, where the diameter of the distal section is 0.311 inches (7.9 mm) and the diameter of the proximal section is 0.255 inches (6.5 mm), the middle section may have a length of 6.11 inches (155 mm). In this case the rate of the change in diameter of the middle section is 0.009. In one embodiment, this is the proper amount for the arrow shaft to taper. With greater or lesser diameter shafts, the middle section may be longer or shorter, as is needed. However, the middle section may also taper somewhat more sharply or less sharply to give the middle section 102 a different length as needed. Nothing in this disclosure is meant to limit the tapering or length of the middle section of the arrow shaft.

As shown in FIGS. 1A and 1B and 2A and 2B, in some embodiments of a dual-diameter arrow shaft, the distal diameter is similar to that of other hunting arrows, while the proximal diameter, which includes the majority of the arrow shaft, has the diameter of a micro-diameter arrow. In one embodiment, the distal diameter is that of a standard hunting arrow, for which any number of inserts or outserts may be commercially manufactured, allowing said commercial inserts, outserts, or tips to be installed on the arrow. These inserts may include, but are not limited to, tracking devices, extra weights, broadheads, other arrow tips, or other additions. In one embodiment of the invention, the greater diameter of the distal section provides greater stability and strength for the arrow than that of an arrow shaft with a small diameter throughout, helping prevent breakage of the arrow upon impact with the target and improve arrow penetration.

In one embodiment of the instant disclosure, the proximal diameter is similar to that of a micro-diameter shaft. This may allow an archer to use standard commercially manufactured micro-diameter nocks in the arrow. In one embodiment, the smaller diameter may give less drag on the arrow as the arrow passes through a target than an arrow which has a standard diameter throughout, allowing for more penetrating power. In one embodiment the diameter of the majority of the arrow is the diameter of the proximal section of the arrow, giving the arrow many of the other advantages of a micro-diameter arrow, such as improved penetration due to less drag. In one embodiment, this feature creates an arrow wherein accessories and tips made for a standard-sized arrow can be used on the distal section of the arrow, and the distal section of the arrow is strengthened where the tip and accessories are attached, while the penetration is improved by the smaller diameter shaft of the proximal section.

In one embodiment of a dual-diameter arrow shaft, the different sections of the arrow may have different lengths than expressed above. While the measurements above represent embodiments of the instant disclosure, the instant disclosure also contemplates arrow shafts which may have different-length sections than expressed above. By way of example and not limitation, the middle section of the arrow shaft may be extended to be longer and provide a more gradual taper, or the distal section of the arrow may be extended to provide additional space at the front of the arrow with a wider arrow shaft for the installation of arrow inserts or additional components.

In cutting the arrow shaft to the proper length for a bow, in general the proximal section of the arrow shaft would be cut, leaving the distal section at the same length as manufactured. However, either the distal section or the proximal section may be cut. In general, the proximal section would be cut, leaving the distal section having a length of approximately 5.18 inches, but the distal section may be cut to a shorter length in fitting the arrow to the bow if desired by the user. In one embodiment, the total length of the arrow shaft may be approximately thirty-two (32) inches, however, this may be adjusted as needed for individual bows.

One embodiment of this disclosure comprises a pre-made arrow shaft ready to be cut to fit the appropriate draw length of a bow it is to be used with. In one embodiment the arrow is cut on the proximal section so as to not affect the distal section of the arrow.

In a further embodiment, the distal end of the arrow may be heavier than the proximal end, providing a greater weight front of center for the arrow. In this embodiment the center of mass of the arrow is nearer to the distal end than it is to the proximal end.

In a another embodiment of the arrow shaft of the instant disclosure, the arrow shaft may be designed to be used with a weight affixed to the front (distal) portion of the arrow. This weight provides additional weight to the front of the arrow. In one embodiment this weight may be designed to be attached to the distal end of an arrow shaft by sliding along it as a sleeve. In another embodiment this weight may be screwed into the distal end of the arrow shaft, which may be provided with a threaded bore to attach additional elements to. In another embodiment, any insert or addition which may be added to a standard-sized hunting arrow may be attached to the distal section of the arrow shaft.

In one embodiment of the instant disclosure, the arrow shaft is used to create a complete arrow, attaching fletching and a nock to the proximal end and attaching a broadhead or fieldpoint to the distal end. The point, fletching, and nock may be attached in any manner known in the art. In addition, other additions may be added to the arrow, such as weights or tracking devices. In one embodiment, points and other additions designed for use with a larger diameter arrow may be attached to the distal section of the arrow. One of the advantages of the instant disclosure is that additions for smaller or micro-diameter arrows are more difficult to make without causing the shaft to break, and so it may be easier to find points and other additions which fit a larger diameter arrow. In one embodiment, additional weight may be added to the arrow in the form of a sleeve designed to fit a standard diameter hunting arrow. In one embodiment, the distal section of the arrow has a diameter which is designed to allow said sleeve to fit snugly on the arrow, while the proximal section of the arrow has a smaller diameter which reduces drag and increases penetrating power by reducing friction as the arrow passes through an animal. In addition, the greater diameter of the front section may reduce the breakage of arrows upon impact.

In cutting the arrow to length, generally the proximal end is cut to length in order to avoid altering the distal end. In another embodiment, an additional weight in the form of a sleeve is attached to the distal end. In an embodiment the inner diameter of this sleeve is equal to the diameter of the distal section of the arrow.

One embodiment of the instant disclosure may embody a method for installing additions designed for larger diameter arrows on an arrow while having greater penetrating power and less resistance characteristic of a smaller diameter arrow shaft. This embodiment may include providing an arrow shaft as shown in FIG. 2A and described above, having a distal section with a larger diameter. In one embodiment, the distal section has a diameter equivalent to that of a standard hunting arrow. The arrow may also have a proximal section having a diameter smaller than that of the distal section in order to reduce drag and increase penetration power. In one embodiment, the diameter of the proximal section may be equivalent to that of a micro-diameter hunting arrow shaft. In one embodiment, the proximal section may make up the majority of the arrow. Finally, in one embodiment the arrow also comprises a middle section wherein the diameter tapers from the distal diameter to the proximal diameter. The arrow additions may be broadheads, other types of tips for the arrow, inserts, outserts such as weights, or other additions such as tracking devices, which are designed to be installed on a standard-diameter arrow. Any other type of addition to the arrow which is designed to be installed on a larger diameter or standard diameter shaft is intended to be encompassed by this disclosure. These additions are then installed on the distal section of the arrow just as they would be on a standard diameter arrow. The proximal section of the arrow has a smaller diameter, thereby providing the greater penetrating power and smaller resistance characteristic of a micro-diameter arrow. The advantages may not be precisely the same as an arrow which has a micro-diameter shaft throughout; however, the arrow maintains advantages of both the standard shaft in choice and variety and some of the increased penetrating power and other advantages of the micro-diameter shaft.

U.S. patent application Ser. No. 16/698,762, filed Nov. 27, 2019, for System and Method for Modifying the Trajectory of an Arrow, is hereby incorporated herein in its entirety.

In the foregoing Detailed Description, various features of the disclosure are grouped together in a single embodiment for the purpose of streamlining the disclosure. This method of disclosure is not to be interpreted as reflecting an intention that the claimed disclosure requires more features than are expressly recited in each claim. Rather, as the following claims reflect, inventive aspects lie in less than all features of any single foregoing disclosed embodiment. Thus, the following claims are hereby incorporated into this Detailed Description by this reference, with each claim standing on its own as a separate embodiment of the disclosure.

It is to be understood that the above-described arrangements are only illustrative of the application of the principles of the disclosure. Numerous modifications and alternative arrangements may be devised by those skilled in the art without departing from the spirit and scope of the disclosure and the appended claims are intended to cover such modifications and arrangements. Thus, while the disclosure has been shown in the drawings and described above with particularity and detail, it will be apparent to those of ordinary skill in the art that numerous modifications, including, but not limited to, variations in size, materials, shape, form, function and manner of operation, assembly and use may be made without departing from the principles and concepts set forth herein.

What is claimed is:

1. A dual-diameter arrow shaft comprising:

An arrow shaft having a proximal section and a distal section, with a middle section linking the proximal section and the distal section, said arrow shaft having a proximal diameter and a distal diameter;

Wherein the arrow shaft is smooth across the entirety of the shaft;

Wherein the diameter of the proximal section is the proximal diameter and the diameter of the distal section is the distal diameter;

Wherein the distal diameter is larger than the proximal diameter; and

Wherein the middle section has a diameter which tapers smoothly and continually from the distal diameter to the proximal diameter; and Wherein the proximal section comprises at least half the length of the arrow shaft;

Wherein the arrow shaft also has a thickness, wherein the thickness is the thickness of the wall of the arrow shaft and is half of the difference between an inner diameter and a outer diameter of the arrow shaft;

Wherein the proximal thickness is the thickness of the arrow shaft at the proximal section;

Wherein the distal thickness is the thickness of the arrow shaft at the distal section;

Wherein the proximal thickness is greater than the distal thickness.

2. The dual-diameter arrow shaft of claim 1, wherein the distal section has a length of between approximately 4 and 6 inches long.

3. The dual-diameter arrow shaft of claim 1, wherein the distal section has a length of approximately 5.18 inches.

4. The dual-diameter arrow shaft of claim 1, wherein the diameter of the distal section is between approximately 7 mm and 10 mm.

5. The dual-diameter arrow shaft of claim 1, wherein the diameter of the distal section is approximately 7.9 mm.

6. The dual-diameter arrow shaft of claim 1, wherein the diameter of the proximal section is between approximately 3 mm and approximately 7 mm.

7. The dual-diameter arrow shaft of claim 1 wherein the diameter of the proximal section is approximately 6.5 mm.

8. The dual-diameter arrow shaft of claim 1 wherein the middle section is approximately 0.75 inches long.

9. The dual-diameter arrow shaft of claim 1 wherein the middle section is between approximately 5 inches and approximately 7 inches long.

10. The dual-diameter arrow shaft of claim 1 wherein the middle section is approximately 6.11 inches long.

11. A dual-diameter arrow comprising:

An arrow shaft with a proximal section and a distal section;

Wherein the distal section has a diameter larger than the diameter of the proximal section;

Wherein the distal section takes up the front portion of the arrow shaft;

Wherein the proximal section comprises at least half the length of the arrow;

A point affixed to a distal end of the arrow; and

A nock affixed to a proximal end of the arrow;

Wherein the arrow shaft also has a thickness, wherein the thickness is the thickness of the wall of the arrow shaft and is half of the difference between an inner diameter and an outer diameter of the arrow shaft;

Wherein the proximal thickness is the thickness of the arrow shaft at the proximal section;

Wherein the distal thickness is the thickness of the arrow shaft at the distal section;

Wherein the proximal thickness is greater than the distal thickness.

12. The dual-diameter arrow shaft of claim 11, wherein the distal section has a length of between approximately 4 and 6 inches long.

13. The dual diameter arrow shaft of claim 11, wherein the distal section has a length of approximately 5.18 inches.

14. The dual-diameter arrow shaft of claim 11, wherein the diameter of the distal section is between approximately 7 mm and 10 mm.

15. The dual-diameter arrow shaft of claim 11, wherein the diameter of the distal section is approximately 7.9 mm.

16. The dual-diameter arrow shaft of claim 11, wherein the diameter of the proximal section is between approximately 3 mm and approximately 7 mm.

17. The dual-diameter arrow shaft of claim 11, wherein the diameter of the proximal section is approximately 6.5 mm.

18. The dual-diameter arrow shaft of claim 11 also comprising a middle section, wherein the diameter of the middle section tapers from the diameter of the distal section to the diameter of the proximal section.

19. The dual-diameter arrow shaft of claim 18, wherein the middle section is approximately 0.75 inches long.

20. The dual-diameter arrow shaft of claim 18 wherein the middle section is between approximately 5-7 inches long.

21. The dual-diameter arrow shaft of claim 18 wherein the middle section is approximately 6.11 inches long.

22. A method of attaching additions designed to be attached to an arrow having one diameter to an arrow having a smaller diameter throughout the majority of the arrow, wherein additions comprise items added to the front end of an arrow shaft to create a functional arrow, including but not limited to arrow points, inserts, and outserts, said method comprising:

Providing an arrow shaft having a distal section with a larger distal diameter equivalent to the diameter which the additions are manufactured for, a middle section, and a proximal section having a proximal diameter smaller than that of the distal diameter;

Wherein the diameter of the middle section tapers continually from the distal diameter to the proximal diameter;

Wherein the arrow shaft also has a thickness, wherein the thickness is the thickness of the wall of the arrow shaft and is half of the difference between an inner diameter and an outer diameter of the arrow shaft:

Wherein the proximal thickness is the thickness of the arrow at the proximal section;

Wherein the distal thickness is the thickness of the arrow shaft at the distal section;

Wherein the proximal thickness is greater than the distal thickness;

Installing the additions designed for the larger diameter arrow on the distal section of the arrow shaft; and, Wherein the proximal section comprises at least half the length of the arrow.

23. The method of claim 22 wherein the arrow is comprised of carbon fiber and is manufactured by molding the carbon fiber.

24. The method of claim 22 wherein the arrow is comprised of carbon fiber and is manufactured by spinning the carbon fiber around a core.

25. The method of claim 22 wherein the arrow is comprised of carbon fiber and is manufactured by a combination of spinning and molding the carbon fiber.

26. The method of claim 25 wherein an addition comprises an arrow tip which is an insert designed to fit within the shaft of a standard diameter hunting arrow.

27. The method of claim 25 wherein an addition comprises an arrow tip and an insert, wherein said arrow tip is designed to be affixed by screwing it into the insert, wherein said insert fits into the shaft of a standard diameter hunting arrow.

28. The method of claim 22 also comprising affixing a tip designed to fit a standard diameter arrow to the distal section of the arrow.

29. The method of claim 22 wherein the addition comprises a sleeve which is affixed to the arrow, wherein the sleeve comprises additional weight added to the arrow.

* * * * *